United States Patent [19]

Bender

[11] Patent Number: 4,964,578

[45] Date of Patent: Oct. 23, 1990

[54] PULVERIZING MILL CONTROL SYSTEM

[76] Inventor: Martin P. Bender, 1759 Cliffside Ct., Naperville, Ill. 60565

[21] Appl. No.: 278,801

[22] Filed: Dec. 1, 1988

[51] Int. Cl.[5] ..... B02C 25/00

[52] U.S. Cl. ..... 241/30; 241/34; 241/36; 241/73

[58] Field of Search ..... 241/36, 30, 37, 73, 241/285 B, 285 A, 34, 285 R, 33

[56] References Cited

U.S. PATENT DOCUMENTS 4,134,552 1/1979 Fraser et al. ..... 241/73 X
4,651,934 3/1987 Bender ..... 241/36
4,770,568 9/1988 Perez et al. ..... 241/36 X

FOREIGN PATENT DOCUMENTS 889097 2/1962 United Kingdom ..... 241/36

*Primary Examiner*—Mark Rosenbaum

[57] ABSTRACT

A control system is provided for a pulverizing mill so that the operation of the mill can be validated. The control system includes a microprocessor, switches which sense proper screen size and inlet shell orientation, and other electrical components to provide consistent operation of the mill according to preprogrammed parameters.

5 Claims, 7 Drawing Sheets

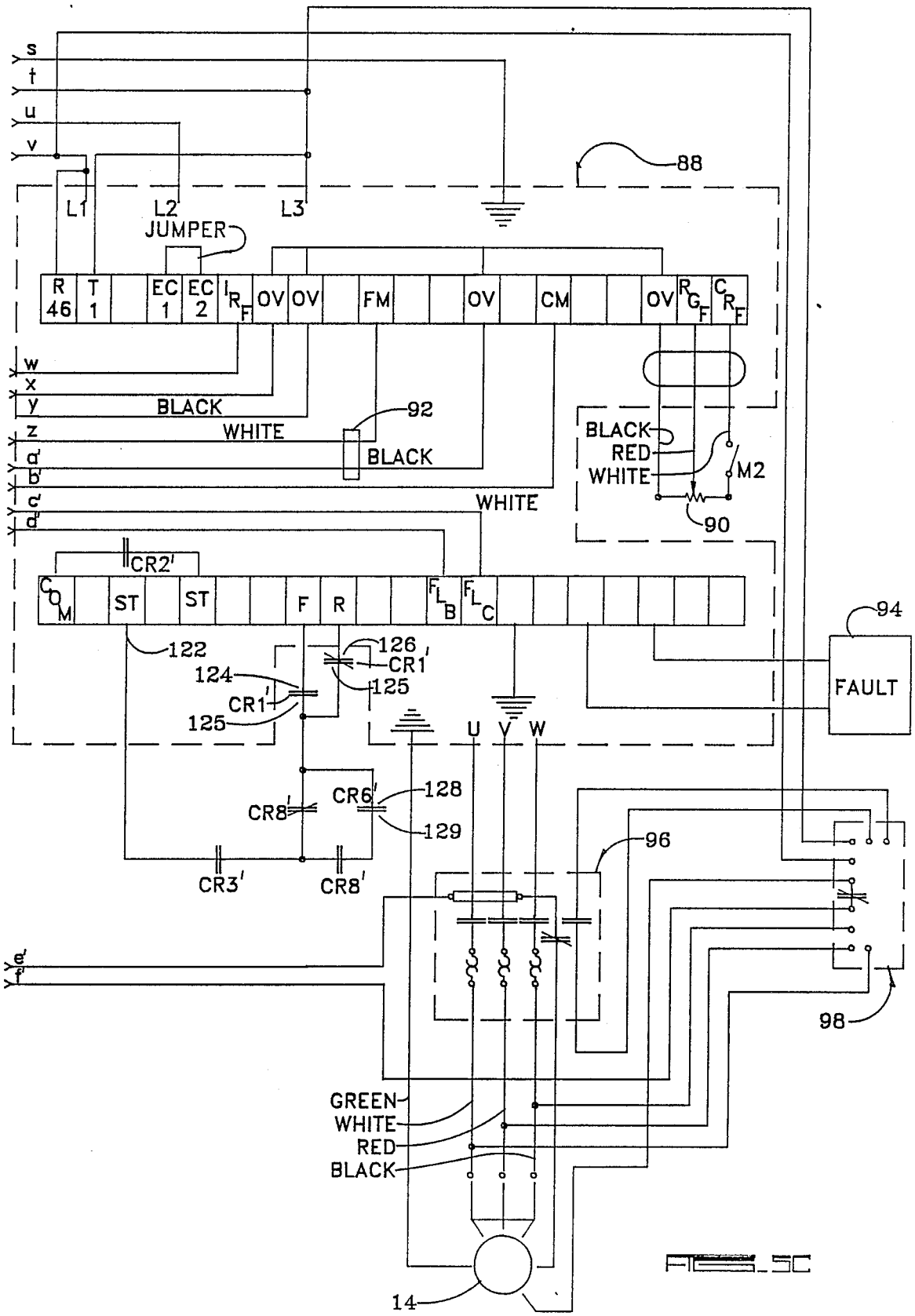
s
t
u
v
88
L1
L2
L3
JUMPER
R 46
T 1
EC 1
EC 2
IRF
OV
OV
FM
OV
CM
OV
RGF
CRF
w
x
y
BLACK
92
z
WHITE
a'
BLACK
b'
c'
WHITE
d'
BLACK
RED
WHITE
M2
90
CR2'
COM
ST
ST
F
R
FLB
FLC
94
FAULT
122
126
CR1'
124
125
CR1'
125
U
V
W
CR6'
128
CR8'
129
96
CR3'
CR8'
e'
f'
98
GREEN
WHITE
RED
BLACK
14

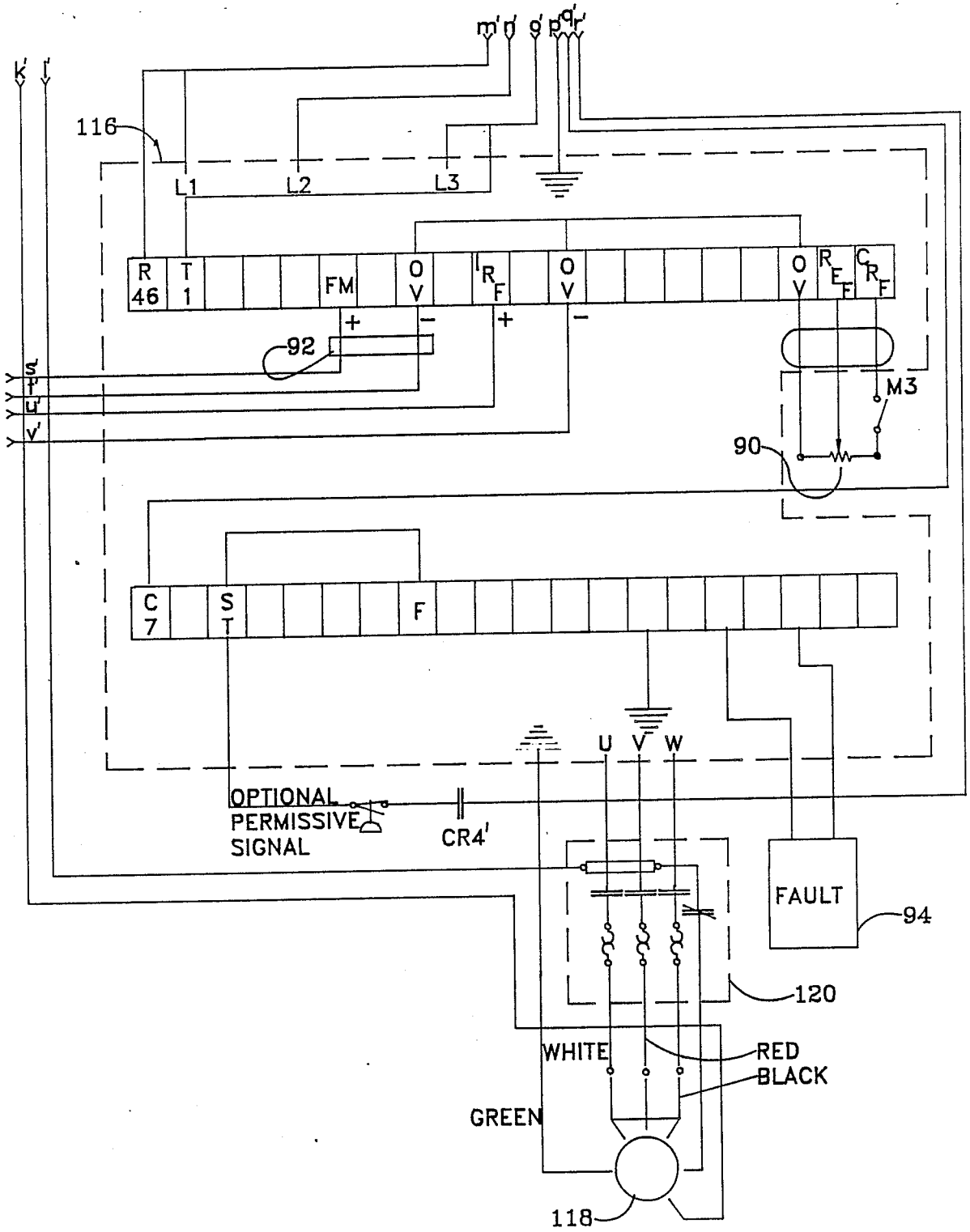
m' n' o' p' q' r'
k' l'
116
L1
L2
L3
R 46
T 1
FM
O V
R F
O V
O V
R EF
C RF
92
s'
t'
u'
v'
M3
90
C 7
S T
F
U V W
OPTIONAL PERMISSIVE SIGNAL
CR4'
FAULT
94
120
WHITE
RED
BLACK
GREEN
118

PULVERIZING MILL CONTROL SYSTEM

BACKGROUND OF THE INVENTION

Pulverizing mills are well known and commonly used to reduce particle size of wet or dry food substances, chemicals, plastics and pharmaceutical products. These mills are typically constructed for use in either batch or continuous operation. An example of one type of pulverizing mill is disclosed in commonlyowned U.S. Pat. No. 4,651,934, of which applicant is a coinventor and which is incorporated by reference herein.

In breaking down bulk products into smaller particles, it is desirable to maintain consistent and repeatable machine operating conditions so as to achieve a consistent particle size. Furthermore, particularly for foods and pharmaceuticals, it is necessary that the operation be validated so that the product can be approved by the U.S. Food and Drug Administration (FDA).

Mills, such as that disclosed in applicant's prior patent, generally include a rotor with a plurality of blades rotatably mounted within a housing. Different particle sizes can be obtained by varying the product feed rate, the rotor speed, the that disclosed in U.S. Pat. No. 3,184,172 have the flexibility to change these parameters. However, in these prior art mills, there has not been a way to validate the operation of the machine, since the machine is manually operated. Such manual operation of the mill leads to inherent mistakes, such as an incorrect screen, blade, rotor speed, or feed rate.

Accordingly, it is a primary objective of the present invention to provide a system for controlling the operation of a pulverizing mill.

A further objective of the present invention is the provision of a method and means for validating the mill operation.

Another objective of the present invention is the provision of control circuitry for validating the mill operation.

Yet another objective of the present invention is the provision of a pulverizing mill control system that automatically checks the initial set-up of the mill, including such parameters as screen size, and blade shape, and sets rotor speed and feed rate.

Another objective of the present invention is the provision of a pulverizing mill with a control system that can be locally programmed or operated through a central computer or microprocessor.

These and other objectives will become apparent from the following description of the invention.

SUMMARY OF THE INVENTION

A control system for a pulverizing mill is provided so that the operation of the mill can be validated. The control system generally includes a microprocessor and electrical circuitry operably connected to the mill. Rotor speed and feed rate are pre-programmed into the microprocessor. Means are provided for sensing the relative position of the feed inlet with respect to the mill housing, which controls the direction of rotation of the rotor and thus the blade face which is presented to the bulk product. Means are also provided for sensing the screen size. Through the electrical circuitry and the microprocessor, the mill will operate only when the appropriate initial set-up signals are sensed. Accordingly, validation of the mill operation can be assured.

BRIEF DESCRIPTION OF THE DRAWINGS

FIGS. 5A–5E are enlarged views of portions of the electrical circuitry shown in FIG. 4. FIG. 5A is taken within line 5A—5A of FIG. 4; FIG. 5B is taken within line 5B—5B of FIG. 4; FIG. 5C is taken within line 5C—5C of FIG. 4; FIG. 5D is taken within lines 5D—5D of FIG. 4; and FIG. 5E is taken within line 5E—5E of FIG. 4.

DETAILED DESCRIPTION OF THE DRAWINGS

Figure 1:
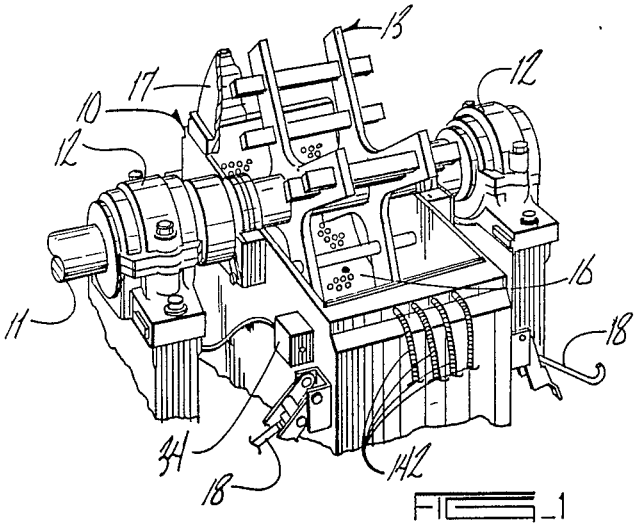
FIG. 1 is a partial perspective view of a pulverizing mill, with the inlet housing broken away to show the rotor and impact blades, the discharge screen, and showing the inlet cover hold-down latches, disengaged.
Figure 2:
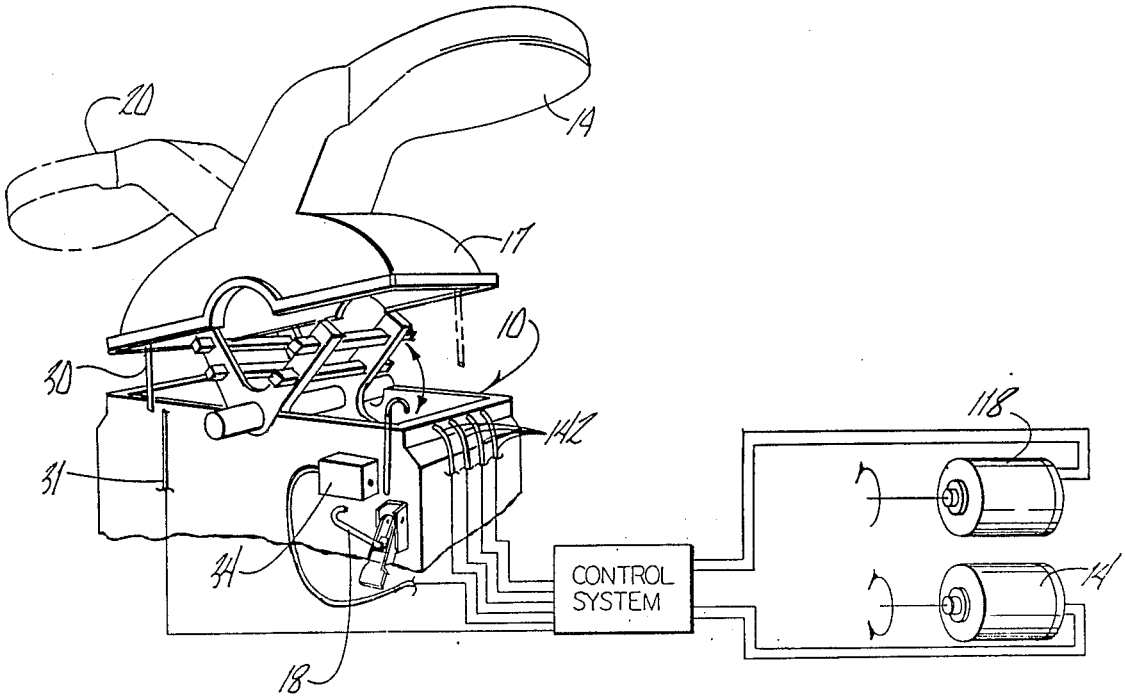
FIG. 2 is a combined perspective and block schematic diagram illustrating the inlet housing and feed chute of the mill in relationship to the optical position detector and the control system of the present invention.

The disclosure of U.S. Pat. No. 4,651,934 is incorporated herein by reference. Generally, the pulverizing mill as shown in FIGS. 1 and 2 consists of a body shell 10 into which a shaft 11 extends, supported for rotation by bearing blocks 12. A rotor assembly 13 is carried by and keyed to the shaft 11 and is driven by the shaft 11 from a motor or other power source 14. A discharge screen 16 permits pulverized material of the desired fineness to pass through a discharge opening (not shown) beneath the body shell and into a bag, receptacle, or closed conveying system.

An inlet shell 17 is secured to the body shell 10 by quick release fasteners 18 located at the four corners of the inlet shell 17. Inlet shell 17 includes a chute 19 through which feed material may be directed into the rapidly turning rotor 13. Other alternative inlets may be provided, such as feed screws, liquid connectors, pneumatic conveyors, or gravity feed chutes.

The mating surfaces of the body shell 10 and inlet shell 17 are symmetrical and reversible. The inlet shell 17 can be assembled to the body shell 10 in a first position or a second position rotated 180° from the first position. The direction of rotor rotation should be coordinated with the position of inlet shell 17. When the rotor rotates in a counterclockwise direction, the inlet chute 19 (solid lines in FIG. 2) should direct the incoming feed material tangentially and in the same direction as the movement of the rotor blades to minimize blow-back of the pulverized material into the inlet chute 19. When the inlet shell 17 is reversed (broken lines 20 in FIG. 2), the direction of rotor rotation should similarly be reversed so as to minimize the blow-back of the pulverized material into the inlet chute 19.

To assure that the direction of rotation of the rotor coordinates with the position of the inlet shell, indicator tab 30 is provided on inlet housing 17, and a first sensing means 31 is provided to sense the position of tab 30. When tab 30 is detected in the location for clockwise rotation of the rotor, sensing means 31 actuates the motor to rotate in a clockwise direction. When the tab is not detected, the motor is actuated for counterclockwise rotation. In this manner, the direction of motor rotation, and thereby rotor rotation and blade surface, is automatically selected to correspond to the position of the inlet shell 17. The motor 14 therefore cannot be started in the wrong direction which might force feed material and pulverized product back through inlet chute 19, rather than out through the discharge screen 16.

A safety interlock is also provided to prevent mill operation when the inlet housing is not securely locked into place by the fasteners 18. Sensing means 34 are provided adjacent to at least two of fasteners 18 at diametrically opposed corners of the body shell 10. Each of the sensing means 34 must detect the existence of a latched condition at the opposite corners of the inlet shell 17 and convey a signal to an electrical circuit which energizes the motor. If one or more of the fasteners become loose during operation of the mill, the motor is automatically shut off by the sensing means 34.

The above description is disclosed in U.S. Pat. No. 4,651,934, and therefore does not constitute a part of the present invention. The present invention is directed towards the control system for the pulverizing mill, as described below.

Figure 4:
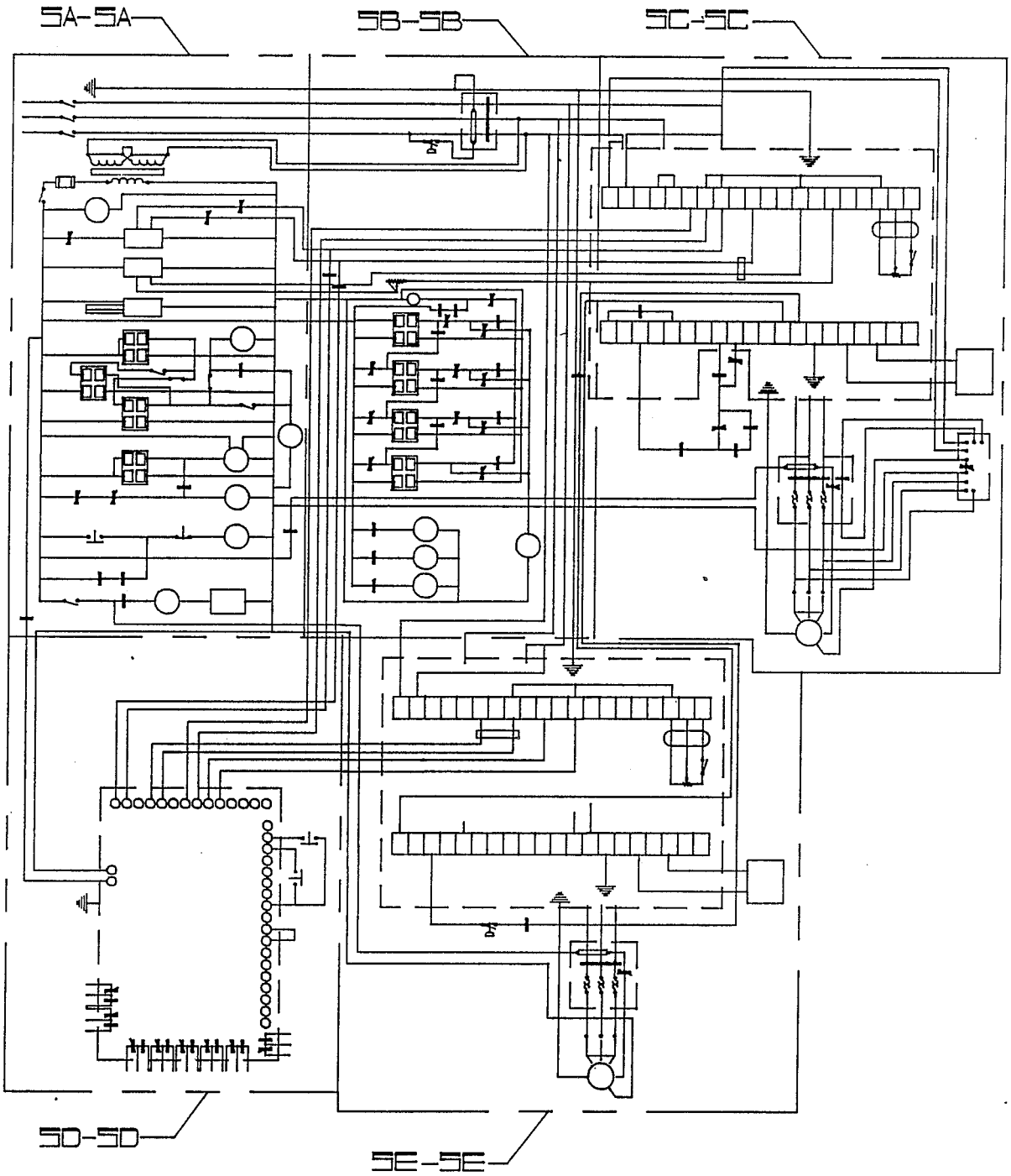
FIG. 4 is an electrical schematic diagram showing a preferred embodiment of the control system of the present invention.

The control system of the present invention includes numerous electrical components, which will be summarized with reference to the FIGS. 5A–5E. The operation of the system will then be described. It is to be understood that FIG. 4 schematically depicts the complete electrical diagram for a preferred embodiment of the control circuitry according to the invention. FIGS. 5A–5E depict enlarged sections of FIG. 4, and lower case letters are utilized to depict connections between FIGS. 5A–5E. Preliminarily, the circuitry includes a plurality of mechanical relays. The relays are designated as CR1–CR12. It is to be understood that in FIG. 5A–5E the relays CR1–CR12 are depicted to show, first, the location of the contacts for each relay (designated by CR1'–CR12' respectively), and whether they are normally open or normally closed (shown by the diagonal line for normally closed). Secondly, the encircled designations CR1–CR12 refer to the position in the circuitry for the coils for each relay. As is well known within the art, coils CR1–CR12 would be positioned adjacent to contacts CR1'–CR12' in a physical working embodiment.

Figure 5A:
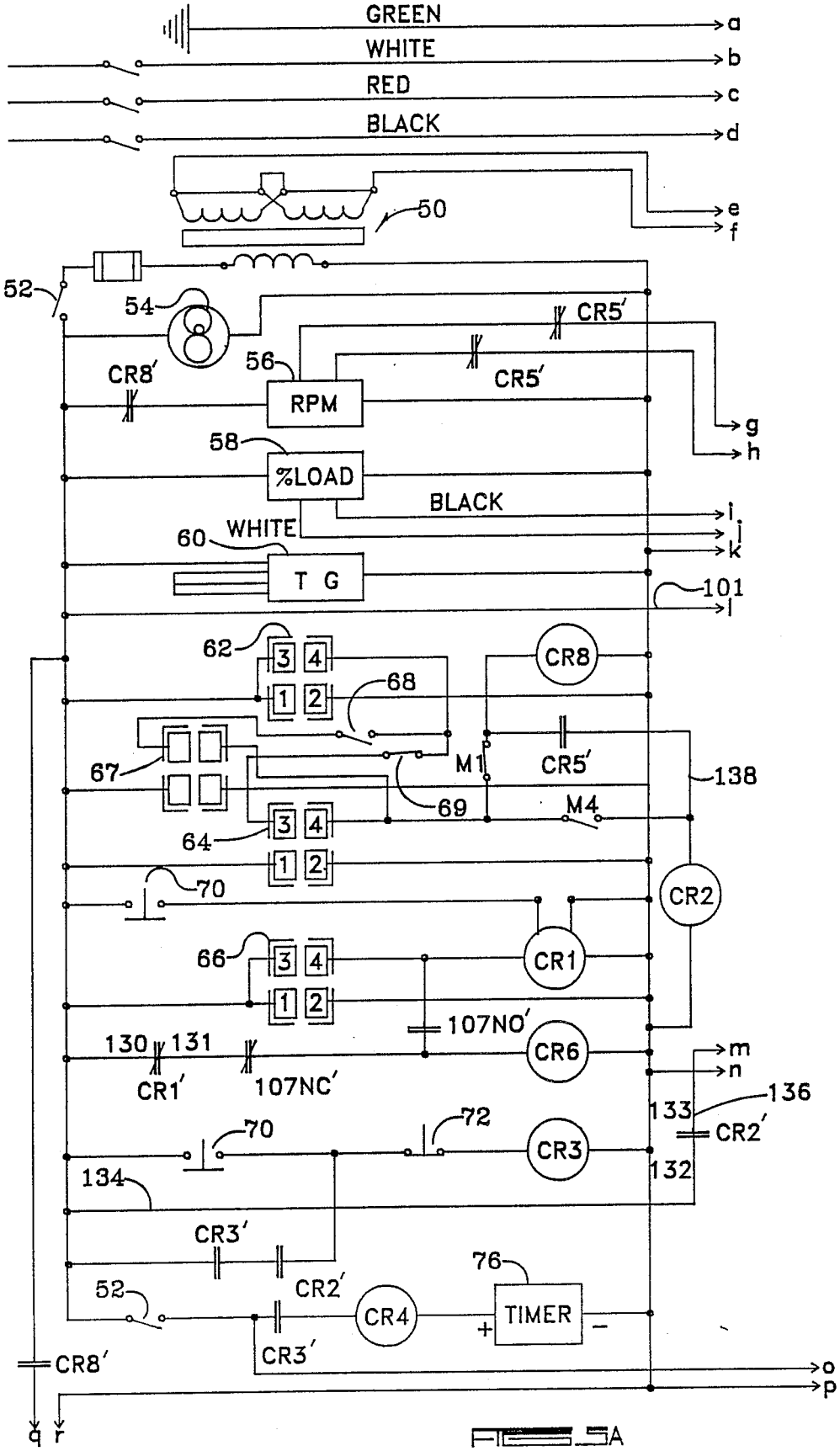

In FIG. 5A, a transformer with a fuse is designated by the reference numeral 50 and serves to step-down to standard 120 VAC electrical power, a level useable for the mill control system. A selector switch 52 is provided, along with a console circulation fan 54. An RPM meter 56 and a percentage load meter 58 are in parallel circuitry with one another. An optional temperature gauge 60 may also be provided. A plurality of switches are incorporated into this system, including fiber optic safety switches 62 and 64, and an auto-reverse switch 66. Switch 66 is in series with a double-pole, double-throw (DPDT) 120 volt latching relay CR1. A second safety switch 67 may be optionally provided. Switches 62, 64, 66 and 67 are depicted by two sets of contacts in square blocks, numerals 1 and 2 are the hot side and neutral side of the power circuit, respectively, and numerals 3 and 4 are switched logic contacts, respectively. Also, contacts 68 and 69 which are normally open and normally closed, respectively, are also optional. A pair of operator actuated push button start switches 70 and an operator actuated stop push button 72 are shown. Also shown in FIG. 5A is a plurality of four pole double throw (4PDT) 120 volt coil relays CR2, CR3 and CR8, a solid state timer 76, and DPDT 120 volt relays CR4 and CR6.

Figure 3:
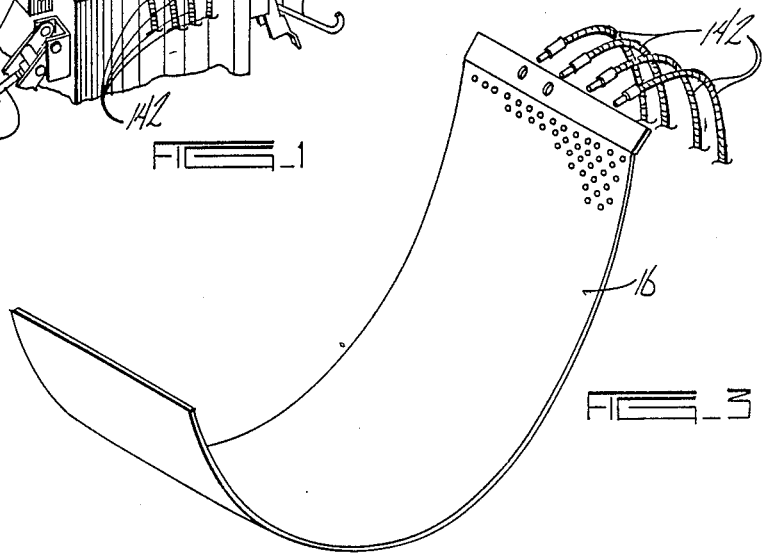
FIG. 3 is a perspective view of the screen and screen sensor means of the present invention.
Figure 5B:
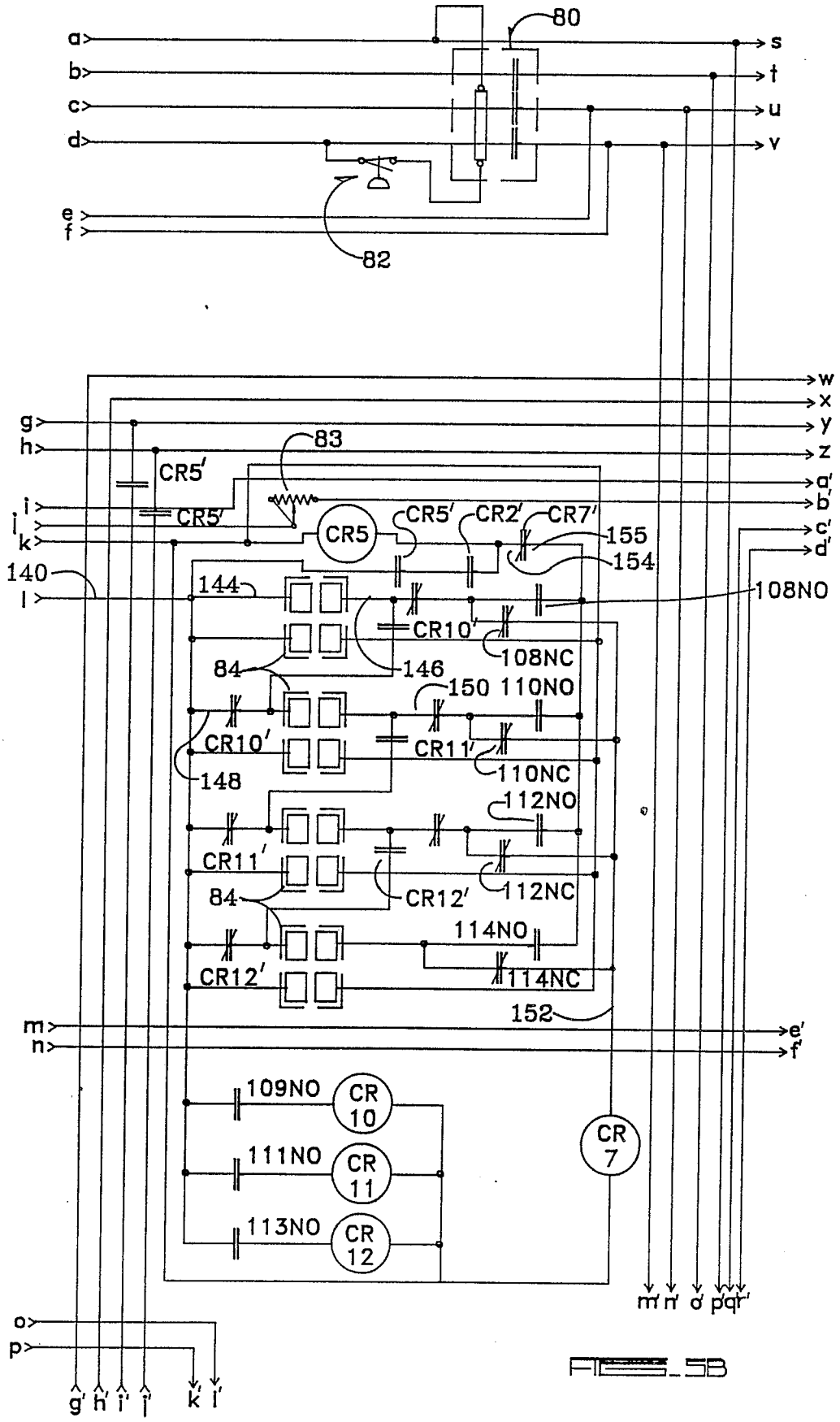

Referring to FIG. 5B, a normally open contact or contactor door is designated by the reference numeral 80 and a differential pressure switch is shown with the numeral 82. A potentiometer jumper 83 is also provided. Another 4PDT relay CR5 is provided, along with a plurality of fiber optic switches 84 for checking the size of screen 16, (FIG. 3) as described below. Additional DPDT 120 volt relays CR7, CR10, CR11 and CR12 are also provided.

FIG. 5C generally shows the portion of the control system which relates to the rotor motor. More particularly, a variable frequency drive 88 is diagramatically shown within the dotted line of FIG. 5C. Drive 88 includes a variable frequency drive potentiometer 90 and a card transducer 92. A status indicator or fault light 94 is also provided. A starter 96 and a brake 98 control the actuation and deactuation of motor 14.

Figure 5D:
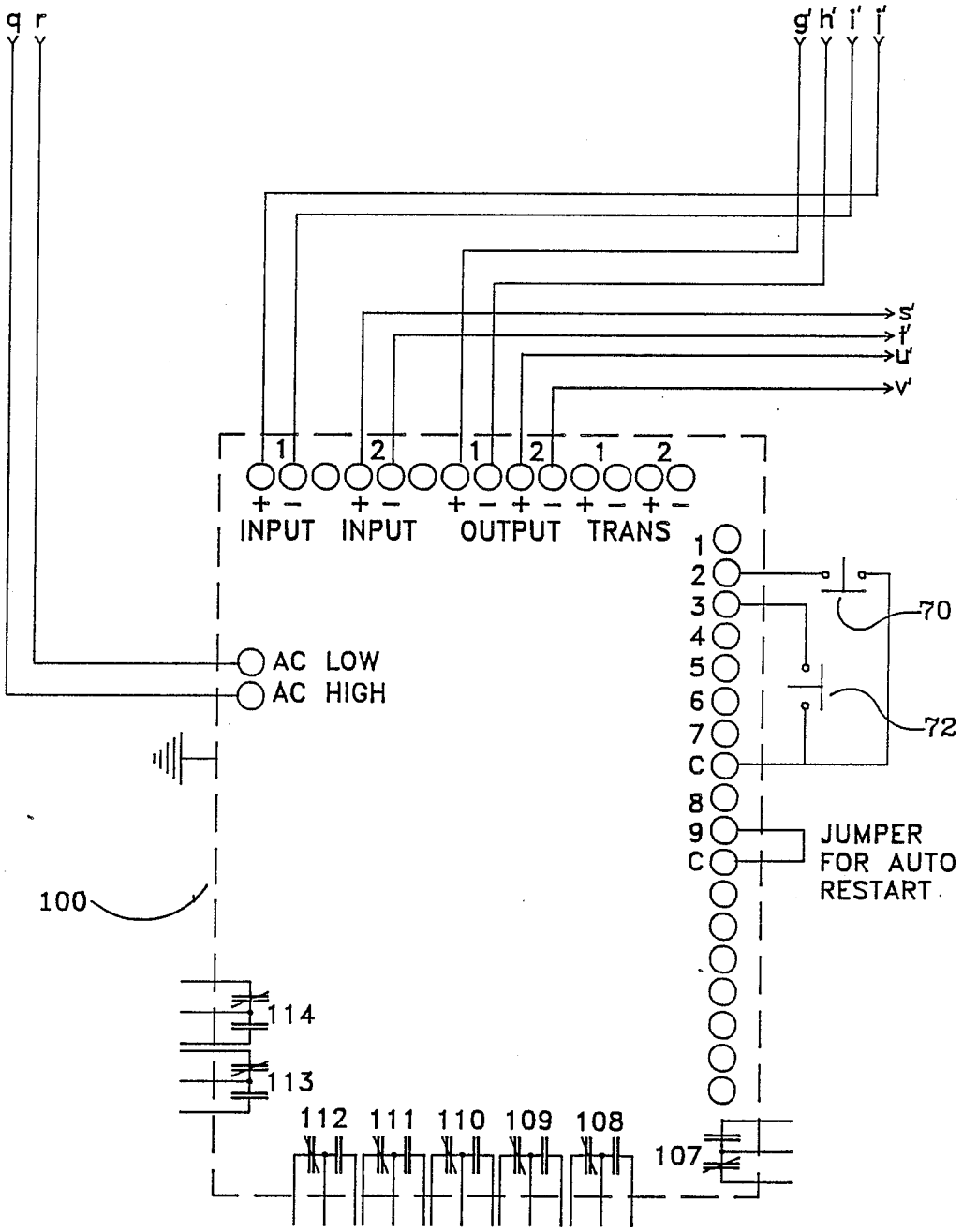

FIG. 5D illustrates the microprocessor 100 used in the present invention. Microprocessor 100 includes an operator push button start switch 70 and an operator actuated stop switch 72. The microprocessor also has a plurality of inputs and outputs, a jumper for automatic restart, and a plurality of mechanical relays 107–114 having two sets of contacts, one of which is normally open and one which is normally closed.

FIG. 5E diagramatically illustrates the portion of the control system relating to the product feed motor. More particularly, a variable frequency drive 116 is represented by the components within the dashed line. Drive 116 is similar to drive 88, including the potentiometer 90 and the transducer 92. The feed mechanism (not shown) is run by a feed motor 118 which is actuated by a starter 120. A status indicator or fault light 94 is also provided for the feed mechanism.

The purpose of microprocessor 100 is to automate and validate the mill operation by adding a permissive circuit which allows the mill to operate only when the proper blade shape is selected and only if the proper screen size has been installed in the housing. The blade shape is dependent upon the position of inlet shell 17 relative to housing 10, as sensed by sensing means 31, as previously described, since other sensors could not be utilized to sense the blade shape directly. Thus, this type of permissive system both establishes and allows complete validation of the blade face being utilized by indirectly detecting pan orientation which by way of the control system determines the blade face utilized.

The software program for the microprocessor controls the operating speed of the rotor and the feed rate of the bulk product, plus establishes the rotor direction (blade surface) and screen hole size. These parameters can be altered by setting up different programs for providing different milling operations and storing them in a memory module (cartridge) or transporting them via digital communications networks into memory banks or host computer systems.

The present invention does not attempt to control the speed of the mill by comparing the input speed signal of the rotor to the program and varying the rotor speed in response to actual operating conditions. Rather, due to variabilities that occur in the milling operation, it is preferable to establish a set point for rotor speed and product feed rate, and then use the set points as the output signal to the variable frequency drives 88 and 116 within the control system of the mill.

An established program can be stored and later recalled for use with a specific product to be milled. Thus, subsequent milling operations for the same product will have the same operating conditions such that the operation is validated.

In setting up the mill for operation, the operator must insert a screen 16 and must select a proper blade for pulverizing the bulk product. As disclosed in U.S. Pat. No. 4,651,934, the blade is automatically selected by the manner in which the cover is placed on the housing, which in turn automatically selects the direction of rotation of the rotor so as to rotate in the proper direction.

In addition to the components described above, the control circuitry of the mill includes a key lock switch to select hand or automatic control, designated by the reference characters Ml (FIG. 5A), M2 (FIG. 5C), M3 (FIG. 5E), and M4 (FIG. 5A), and a relay CR8 (FIGS. 5A and 5C), which is energized when the switch is in the automatic position. This energizing of relay CR8 effects several circuits, including the starting circuit on the rotor drive motor 14, which is depicted by the wire 122 (FIG. 5C) running from the contacts labeled ST to either the forward or reverse contacts labeled F and R, respectively. When the operator pushes the start button 70 with relay CR8 not energized, a start signal is generated and proceeds to either the F or R contact, depending upon the orientation of inlet shell 17 upon the rotor housing 10.

The automatic reversing system which controls the direction of rotation of the rotor and blades utilizes sensing means 31, which in the preferred embodiment includes fiber optic switch 66 in series with relay CR1 (FIG. 5A). Relay CR1 flip-flops its contacts 124, 125 and 126, 125 (FIG. 5C) which are connected to contacts F and R on the variable frequency drive 88. Thus, if relay CR1 is energized due to receipt of a signal from fiber optic switch 66, the relay will close contacts 124, 125 and open contacts 126, 125. Accordingly, motor 14 will run in the forward direction. If no signal is received by relay CR1, the relay does not energize and contacts 126, 125 remain closed, such that the motor runs in the reverse direction.

The verification or validation system of the present invention provides a permissive interlock. The position of inlet shell 17 on housing 10 dictates the direction the rotor and blades will rotate, and thus the blade surface which will impact on the product. Through the use of microprocessor 100, the mill can be programmed to run in either the forward or reverse direction by dictating how the variable frequency drive 88 receives its start signal. This is illustrated by contacts 107NC and 107NO, which is a programmed relay output of the microprocessor. These contacts are placed in series with contacts from relay CR1 and relay CR6 (FIG. 5A). Thus, if the mill is programmed to operate in the reverse direction, the program calls for contact 107NC to remain closed, and relay CR6 can only be energized if relay CR1 fails to receive a signal from fiber optic switch 66 so as to remain unenergized. If relay CR1 is not energized, relay CR6 closes, along with contacts 128, 129 (FIG. 5C). These contacts are in series with the contacts from relay CR18 (auto/man switch circuit), thereby allowing a start signal from contact ST to flow through CR3 (start circuit) to terminal R. If the operator places inlet shell 17 in the wrong direction, relay CR1 will energize, thereby opening its contacts 130, 131 (FIG. 5A) so as to prevent relay CR6 from energizing. Accordingly, motor 14 will not receive a start signal. Conversely, if it is desired to operate the mill in the forward direction, the program will call for contact 107NO to close and contact 107NC to open. Thus, both relays CR1 and CR6 will energize, when there is a signal from the fiber optic switch 66. This will then allow the start signal from contact ST to pass through to the forward contact F and thereby actuate the motor to rotate in the forward direction.

Thus, it can be seen that the mill will not receive a start signal unless the signal generated by switch 66, or the lack thereof, corresponds to the pre-programmed signal, as dictated by the position of the 107NC-NO contacts controlled by microprocessor 100. It should also be noted that this start signal can be generated only if the contacts 132, 133 for relay CR2 (FIG. 5A) close in line 134, which connects to line 136, which in turn energizes the coil and the motor starter 96. If relay CR2 does not close, the coil will not energize and the starter will not close and the variable frequency drive 88 will remain unconnected.

The coil of relay CR2 is in line 138 (FIG. 5A), which emanates from the safety control circuit of fiber optic switches 62 and 64, as well as incorporating contacts from relay CR5 when the hand auto switch M1-M4 is in the automatic position, as shown in the drawings. In order to energize the coil of CR5, a signal must proceed from line 140 through the maze created by the four fiber optic switches 84, microprocessor relays 108NC/108NO through 114NC/114NO, and relays CR10 through CR12 (FIG. 5B). These switches and relays form the screen-checking circuit. A typical screen verification code pattern is as follows:

| CODE | | | | HOLE SIZE (INCHES) | OPEN AREA (%) |
|---|---|---|---|---|---|
| 1 | | | | .020 | 22 |
| | 2 | | | .028 | 23 |
| | | 3 | | .038 | 34 |
| | | | 4 | .045 | 36 |
| 1 | 2 | | | .063 | 41 |
| | 2 | 3 | | .078 | 45 |
| | | 3 | 4 | .109 | 46 |
| 1 | 2 | 3 | | .156 | 63 |
| | 2 | 3 | 4 | .265 | 65 |
| 1 | 2 | 3 | 4 | .625 | 47 |

Fiber optic sensors 142 (FIGS. 1, 2, & 3) are operatively connected to reflective fiber optic switches 84 so as to sense holes (two shown) drilled in the margin of screen 16. If a hole is present in the margin, no reflection will be sensed by the switches 84, which will then close.

The screen permissive circuit would thus operate, for example, as follows. When the first fiber optic switch 84 senses a hole in the margin of screen 16, line 144 is connected to line 146 so as to pass the signal through relay coil CR5, provided contact 108NO is programmed closed by the microprocessor 100 (FIG. 5B). Thus, if the microprocessor has been programmed to call for the screen which has a hole at position number 1 of the code, relay CR5 would energize, which in turn energizes relay CR2, so as to connect motor starter 96 to the variable frequency drive 88, and thereby generate a start signal so as to actuate the motor 14, provided that the inlet shell 17 has been properly positioned by the operator, as previously described.

As a further example, if the operator installs a screen with holes in positions number 1 and number 2 of the code, a signal will be generated from two of the switches 84. In addition, for this example, the program will still be calling for a closure of relay 108NO. In this case, the signal will pass both to relay CR5, and through relay CR7 which includes a set of normally closed contacts 154 and 155 that are prior to and in series with relay CR5. In this example, the second fiber optic switch 84 will allow a signal to proceed from line 148 to line 150 (FIG. 5B). This signal will pass through contacts 110NC, since there is no programmed change for relay CR11, and then pass on to line 152. This will energize relay CR7 and open its contacts 154, 155 (FIG. 5B), thereby preventing any signal from proceeding through to relay CR5. The blocking action of relay CR7 will restrict any inadvertent actuation of the screen checking circuit if the operator does not put in the proper screen and have the proper relays programmed open or closed.

Thus, relay CR5 can only be energized if the correct signal gets through the pathway established by the program of the microprocessor. Accordingly, this control system assures that if the operator puts in the wrong screen 16, the mill motor 14 will not start.

The outputs 1 and 2 (FIG. 5D) from microprocessor 100 control the speed setting signal to both the variable frequency drives 88 and 116 on respective contacts OV and IRF (FIGS. 5C and 5E). These signals are established by the microprocessor program in conjunction with the screen size and blade shape permissive program. These input signals to the variable frequency drives 88 and 116 for motors 14 and 118, respectively, can also be controlled through the interface of the microprocessor via a ditigal communications network to a central host computer system. Furthermore, speed control signals which are fed from the microprocessor can also be fed to a central station computer. Changes in speed can only be achieved through changing the programming of the microprocessor or by resetting the parameters through a central computer control.

The microprocessor program can only be changed by the mill operator if he is knowledgeable in the use of the microprocessor and has been informed of the hidden key pads that enable the programming function of the microprocessor or alternatively, the operator can use a pre-programmed cartridge (memory module). Therefore, management can establish a program for the mill and be sure that the operator can only run the mill at the desired speed setting utilizing the program, provided the operator has installed the right screen and selected the correct blade.

Programming training would be reserved for management personnel, thus the operator's only alternative for changing a program would be the use of the cartridge made available to him/her by management.

From the above description, it is seen that the mill can be easily validated and its operating conditions proven. The FDA and other agencies can receive proof of the validated operation through data-logging the outputs from the microprocessor or central host computer system.

It will be understood and appreciated that the present invention can take many forms and embodiments. The true essence and spirit of the invention are defined in the appended claims, and it is not intended that the described preferred embodiment of the invention should limit the scope of the claims.

What is claimed is:

1. A method for controlling the operation of a pulverizing mill, the mill including a housing, an inlet for introducing a bulk product into the housing, a rotor rotatably mounted within the housing and having a plurality of blades thereon with selective faces for breaking the bulk material into particles, a screen of selective size in the housing for sifting the particles, power means for rotating the rotor, feed means for feeding bulk material into the housing, and control circuitry for validating the mill operation, the method comprising:

selecting a rotor blade face for pulverizing the bulk material, generating a first signal corresponding to the selected blade face, and comparing the first signal to a pre-selected blade face signal with the control circuitry;

selecting the screen size, generating a second signal corresponding to the selected screen size, comparing the second signal to a pre-selected screen signal with the control circuitry; and inhibiting the actuation of the power means to rotate the rotor until the first signal matches the pre-selected blade face signal, and the second signal matches the pre-selected screen signal.

2. The method of claim 1 wherein the selection of the blade face is dependent upon the position of the inlet relative to the housing.

3. The method of claim 2 wherein the direction of rotation of the rotor is dependent upon the position of the inlet shell relative to the housing.

4. In an improved pulverizing mill including a housing, an inlet shell removably mounted on the housing for introducing a bulk product into the housing, a rotor rotatably mounted within the housing and having a plurality of blades with selective forward-facing and reverse-facing faces thereon for breaking the bulk product into particles, a screen of selective size mounted within the housing for sifting the particles, feed means for feeding bulk material into the housing, and power means for rotating the rotor in both forward and reverse directions, the improvement comprising:

first sensing means for generating a control signal corresponding to the position of the inlet shell on the housing, second sensing means for generating a control signal corresponding to the size of the screen, a control circuit for validating the mill operation by comparing selected operational parameters with predetermined values for said first and second control signals, whereby the mill operation is inhibited until the control signals match the predetermined values.

5. A method for controlling the operation of a pulverizing mill, the mill having a housing with an inlet for introducing a bulk product into the housing, a rotor rotatably mounted in the housing and having a plurality of blades for breaking the bulk material into particles, a screen in the housing for sifting the particles, power means for rotating the rotor, and control circuitry for validating the mill operation parameters, the method comprising:

selecting parameters for operation from the group consisting of rotor speed, rotor direction, product feed rate, and screen size;

generating signals corresponding to each of the parameters;

comparing the signals to corresponding pre-selected parameter signals with the control circuitry; and actuating the power means when the generated signals match the pre-selected signals.

* * * * *